United States Patent [19]

Kahn

[11] 4,297,801

[45] Nov. 3, 1981

[54] FIREARM WITH INTERCHANGEABLE BARRELS AND AMMUNITION CYLINDERS

[75] Inventor: Harvey R. Kahn, Port Jefferson, N.Y.

[73] Assignee: Alan I. Gerald Corporation, North Haven, Conn.

[21] Appl. No.: 99,846

[22] Filed: Dec. 3, 1979

Related U.S. Application Data

[63] Continuation-in-part of Ser. No. 35,992, May 2, 1979.

[51] Int. Cl.[3] ..... F41C 1/00; F41C 21/00

[52] U.S. Cl. ..... 42/59; 42/77

[58] Field of Search ..... 42/59, 77

[56] References Cited

U.S. PATENT DOCUMENTS

| | | | |
|---|---|---|---|
| 2,150,914 | 3/1939 | Gaidos | 42/59 |
| 2,238,587 | 4/1941 | Gaidos | 42/59 |
| 2,329,273 | 9/1943 | Kelly | 42/59 |
| 2,976,638 | 3/1961 | Owens | 42/59 |
| 3,280,495 | 10/1966 | Lewis | 42/59 |

*Primary Examiner*—Charles T. Jordan

*Attorney, Agent, or Firm*—Berger & Palmer

[57] ABSTRACT

A firearm having interchangeable barrels and ammunition cylinders for changing the caliber of ammunition used therewith includes a plurality of ammunition cylinders and a plurality of barrels, each barrel being threadedly mountable on the firearm frame with each barrel including a longitudinal barrel extension for interfering with the mounting and revolution of the ammunition cylinders for ammunition having a larger caliber than that of the respective barrel, and the improvement therein includes alignment marks on the barrels and frame for alignment under the full threaded engagement of each barrel in the frame, a plurality of sight ribs with each sight rib corresponding to a different barrel, means for attaching each sight rib to its corresponding barrel at a predetermined location to enable each sight rib to its corresponding barrel at a predetermined location to enable each sight rib to be operatively oriented with the rear sight for aiming the firearm when each barrel is fully threadedly engaged in the frame bore, and means for inhibiting attachment of each sight rib to its corresponding barrel when such barrel is only partially engaged in the frame bore for allowing attachment of each sight rib only after its corresponding barrel is fully threadedly engaged in the frame bore.

4 Claims, 6 Drawing Figures

FIREARM WITH INTERCHANGEABLE BARRELS AND AMMUNITION CYLINDERS

CROSS-REFERENCE TO RELATED APPLICATIONS

This application is a continuation-in-part of U.S. patent application Ser. No. 035,992 filed May 2, 1979, the contents of which are hereby incorporated herein.

BACKGROUND OF THE INVENTION

1. Field of Invention

This invention relates in general, to firearms of the revolver type having interchangeable barrels and ammunition cylinders and in particular, to such firearms wherein the interchangeable barrels and cylinders provide a change in the caliber of ammunition to be used with the firearm.

2. The Prior Art

Firearms having interchangeable critical parts such as barrels and ammunition discharge chambers are well known. Such firearms include revolver type weapons in which the ammunition cylinder has a multiplicity of chambers therein and is interchangeable along with the barrel of the weapon. This particular variation has even been used to provide for a change in the caliber of ammunition to be used with the weapon by the matching of interchangeable ammunition cylinders with interchangeable barrels corresponding to the same caliber of ammunition.

In particular, U.S. Pat. No. 3,280,495 discloses a revolver type firearm having a frame for mounting interchangeable ammunition cylinders and barrels. The barrels thereof include a threaded end portion for engagement with the frame and an extension therefrom for reaching past the weapon frame and interfering with ammunition cylinders corresponding to calibers of ammunition larger than that associated with the barrel. This firearm is intended to prevent the use of cylinders for larger caliber ammunition than that for which the mounted barrel is intended. The firearm disclosed includes a shroud which is held to the front of the frame and which surrounds the barrel. The barrel has a nut like structure located at the end opposite the threaded portion which extends beyond the shroud and is used for applying torque for installing and removing the barrel from the frame. Unfortunately, it is still relatively easy, with the firearm disclosed in this patent, to combine an ammunition cylinder of a larger caliber ammunition with a barrel corresponding to a smaller caliber ammunition. The reason for this is that the barrel disclosed in that patent may be installed in the frame without being fully threadedly engaged therein and thus the longitudinal extension at the rear of such a defectively installed barrel would not be operative to interfere with ammunition cylinders for ammunition of larger calibers. The weapon disclosed is such that the full threaded engagement of the barrel or lack thereof may not be readily noticeable upon examination of the weapon.

Another firearm having interchangeable barrels allowing for the use of different caliber ammunition therein is disclosed in U.S. Pat. No. 1,357,393. That patent discloses a pistol having a frame and barrel. The frame includes a firing mechanism but does not include means for mounting a revolver type ammunition cylinder. The bottom of the barrel includes a rib which is intended for insertion in a complementary slot located in the frame. The barrel is secured to the frame by a screw passing through the frame and engaging a portion of the rib. Thus, the only interchangeable part on the weapon is the barrel and the patent does not deal with the problems encountered by having to interchange both the barrel and the ammunition cylinder.

Another means for interchanging barrels on a firearm is disclosed in U.S. Pat. No. 3,877,167. That patent discloses a gun barrel having a locking bushing securely threaded onto its rearward end. The locking bushing is receivable in a breech casing and includes a slot engageable by a pin fixedly located within the breech casing to fix the rotational position of the barrel therein. The barrel is held in the casing by a second bushing rotatable around the barrel and located thereon above the first bushing. The second bushing threadedly engages the breech casing and abuts against the first bushing to press the gun barrel and first bushing into the casing. Thus, this patent does not deal with those problems encountered with a firearm having both interchangeable barrels and ammunition cylinders.

Another means for removably mounting a barrel in a receiver assembly is disclosed in U.S. Pat. No. 3,731,418. In that patent, the receiver assembly is longitudinally slit to permit a receiver flange located thereon to be circumferentially constricted into clamping engagement with the barrel. The patent does not deal with the difficulties encountered with firearms having both interchangeable barrels and ammunition cylinders.

Another method for removably attaching a gun barrel to a receiver therefor is disclosed in U.S. Pat. No. 529,455. The rear portion of the barrel is threaded to receive several bands, one of which is discontinuously threaded so as to thereby have an equal number of threaded and nonthreaded portions evenly distributed around the circumference of the band. The receiver in turn includes a similarly discontinuous thread engageable with the discontinuously threaded band. Engagement is had between the discontinuous threads by inserting them when a threaded portion of one thread is aligned with a blank portion of the other thread. After the threads are so inserted to their fullest extent, the band is rotated less than one full revolution to engage the complementary threaded portions. Thus arranged, the barrel can be easily assembled to the receiver or disconnected therefrom by the described partial rotation of the discontinuously threaded band. The weapon described does not include a revolver type ammunition cylinder or means for installing barrels having different calibers.

Another mechanism for removably attaching a gun barrel to a receiver is disclosed in U.S. Pat. No. 534,691. In this patent the rearward end of the gun barrel includes a thread located on the upper portion thereof. The receiver includes a hole for receiving the rearward end of the gun barrel. The hole includes a thread, complementary to the thread on the rearward end of the barrel, engageable therewith and located on the upper side of the hole. The hole is oval in shape and includes an intersecting cylindrical bore at the lower end thereof. To attach the barrel to the receiver, the barrel is inserted into the hole at the lower end thereof, thus preventing engagement of the threads located on the barrel and on the inside of the hole. After the barrel is fully inserted, a tapered bolt is located within the intersection cylindrical bore and secured by rotation. The taper of the bolt forces the gun barrel upward in the receiver hole, thus causing the complementary threads to engage securing the gun barrel in the receiver. Thus, this patent does not disclose a firearm having a revolvable ammunition cylinder and does not discuss such firearms having both interchangeable barrels and ammunition cylinders.

SUMMARY OF THE INVENTION

The present invention provides a firearm having a frame for mounting interchangeable barrels and cylinders with the barrels including longitudinal extensions for interfering with the installation and revolution of an ammunition cylinder for a larger caliber ammunition than that of the respective barrel. The improvement in such firearm includes a plurality of interacting safety features including alignment marks on each of the different barrels, a frame alignment mark for alignment with the barrel alignment mark when each of the barrels is fully threadedly engaged in a threaded frame bore to insure the full threaded engagement and thereby the operativeness of the longitudinal barrel extension, a plurality of sight ribs with each rib corresponding to a different barrel, means for attaching each sight rib to its corresponding barrel at a predetermined location thereon to enable each sight rib to be operatively oriented with respect to the rear sight for aiding aiming of the firearm when each barrel is fully threadedly engaged in the frame bore, and means for inhibiting attachment of each sight rib to its corresponding barrel when such barrel is only partially engaged in the frame bore for allowing attachment of each sight rib to its corresponding barrel only after each barrel is fully threadedly engaged in the frame bore.

BRIEF DESCRIPTION OF DRAWINGS

The present invention is described with respect to the appended drawings in which.

DETAILED DESCRIPTION OF THE INVENTION

Figure 1:
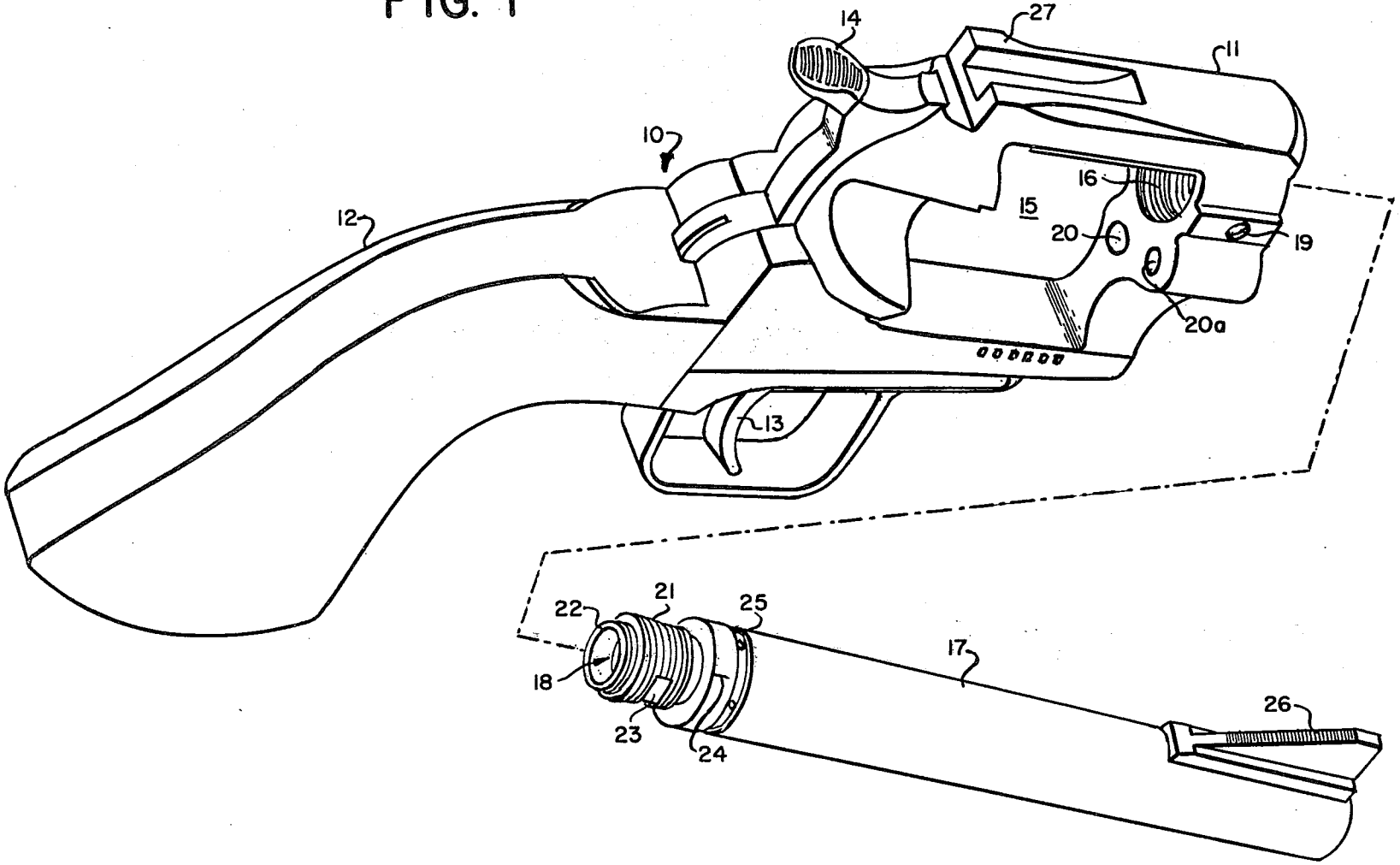
FIG. 1 is a perspective view of a disassembled firearm frame and barrel according to the present invention.

FIG. 1 discloses a firearm 10 including a frame portion 11 and a grip portion 12. The firearm 10 also includes a trigger 13, a hammer 14 and an interconnecting internal mechanism (not shown) for actuating the hammer 14 by the trigger 13 to discharge ammunition. The frame portion 11 includes an opening 15 in which a multiple chamber ammunition cylinder may be mounted. The internal mechanism located within the frame 11 also includes means for rotating an ammunition cylinder so located within the frame 11. Any suitable mechanism may be used for actuating the hammer 14 and rotating an ammunition cylinder. Such mechanisms are quite common as revolvers of this general type have been in existence for many years.

The frame 11 also includes a threaded bore 16 into which a barrel 17 may be mounted. The threaded bore 16 communicates with the opening 15 for allowing the discharge of ammunition from an ammunition cylinder mounted within the opening 15 into the barrel bore 18 of a barrel 17 mounted in the threaded bore 16. The frame 11 also includes a second threaded frame bore 19 for mounting a locking screw therein to secure the barrel 17 when engaged in the threaded bore 16. An additional bore 20 in the frame 11 provides for the removable mounting of a cylinder axle, thereby allowing for the interchangeability of ammunition cylinders.

The frame 11 may optionally include an additional bore 20*a* allowing for the mounting of a ramrod therein for removing discharged ammunition shells from an ammunition cylinder mounted in the opening 15.

The barrel 17, intended for mounting in the threaded frame bore 16, includes a threaded end portion 21 for such mounting purpose. A longitudinal extension 22 reaches beyond the threaded portion 21 and is intended for interfering with the operation of a cylinder within the opening 15 when such cylinder is intended for use with ammunition of a larger caliber than that of the barrel 17. To this end, a plurality of barrels (not shown) is provided for the present invention in which the longitudinal extension varies with the caliber of the barrel bore 18. The smaller the caliber of the bore 18 the larger is the extension 22. In conjunction therewith cylinders intended for mounting in the opening 15 are made having different lengths. The larger the caliber for which the cylinder is intended the greater is the length of the cylinder. By this means a cylinder for a larger caliber ammunition than that of a barrel 17 mounted in the threaded bore 16 will be too large to clear the extension 22 of the barrel 17. This cooperation between cylinder and barrel prevents the discharge of too large a caliber bullet into a barrel bore 18 provided that the barrel 17 is fully threadedly engaged in the frame bore 16. Under conditions where the barrel 17 is not fully threadedly engaged in the frame bore 16, the extension 22 may not reach far enough to interfere with an ammunition cylinder for a larger caliber ammunition.

The barrel 17 also includes a flat portion 23 formed in the threaded portion 21 for abutment with a locking screw mounted in the threaded bore 19 when the barrel 17 is fully threadedly engaged in the frame bore 16. The barrel 17 also includes a barrel alignment mark 24 for alignment with a corresponding mark (31 in FIG. 2) located on the frame 11 when the barrel 17 is fully threadedly engaged in the frame bore 16. The barrel 17 also includes wrench engagement means 25 located in proximity to the threaded end of the barrel 17 which engagement means 25 may be used to engage the barrel 17 with a wrench (not shown) to allow the application of torque thereto for either installing or removing the barrel 17 from the frame 11. Lastly, the barrel 17 includes a forward sight 26 intended for use with a rear sight 27 on the firearm frame, in the aiming of the firearm. As the forward sight 26 is affixed to the barrel 17, it rotates therewith during the installation of the barrel 17 in the frame bore 16 and is positioned such that it is in proper alignment with the rear sight 27 when the barrel 17 is fully threadedly engaged in the frame bore 16. By this means, further and very apparent indication is given as to whether the barrel 17 is fully threadedly engaged in the frame bore 16 and therefore whether the extension 22 reaches far enough to interfere with ammunition cylinders corresponding to larger caliber ammunition than that of the barrel 17.

Figure 2:
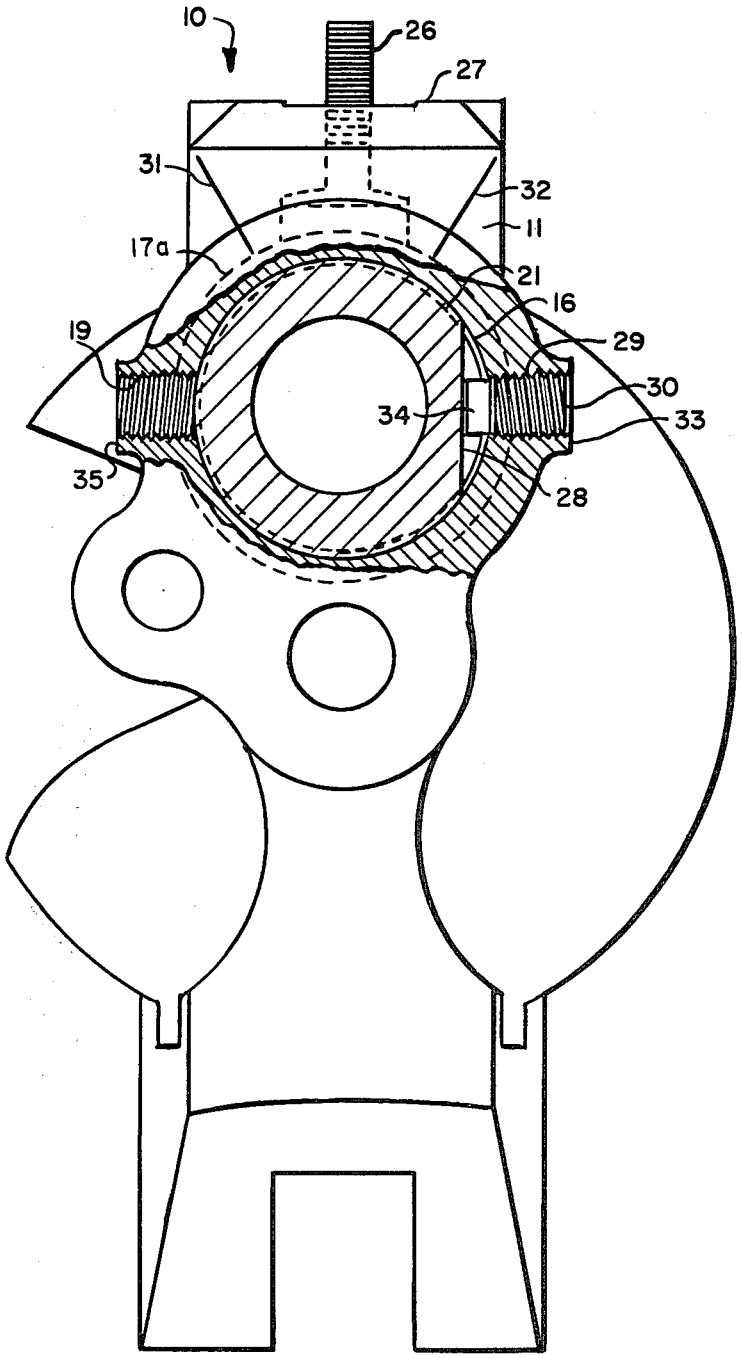
FIG. 2 is a partially sectioned front view of the frame and barrel of FIG. 1 in assembled condition.

FIG. 2 shows a front view of a frame 11 and barrel 17*a* in the assembled condition. The barrel 17*a* is shown substantially in phantom lines except for a portion of the forward sight 26 and a portion located within the base 16. The frame 11 is shown partially sectioned in the area of the threaded bore 19. The barrel 17*a* is sectioned through the threaded portion 21 with the barrel 17*a* fully threadedly engaged in the frame bore 16. The barrel 17*a* of FIG. 2 differs from the barrel 17 of FIG. 1 by having a flat portion 28 in a different location from that of the flat portion 23 in FIG. 1. FIG. 2 also shows an additional threaded bore 29 intersecting with the frame bore 16 for mounting a locking screw 30 therein. The locking screw 30 is shown in engagement with the flat portion 28.

FIG. 2 also shows frame alignment marks 31 and 32 which are intended to be aligned with corresponding barrel marks on each of the barrels 17 and 17*a* to be used with the frame 11. The plurality of marks 31 and 32 are included so that a different mark may be used for each barrel of a different caliber. In this way, the barrel alignment mark 24 shown in FIG. 1 would be in a correspondingly different place on each barrel for different caliber ammunition. Likewise, barrels for different caliber ammunition may have flat portions 23 and 28 located in correspondingly different positions and complemented by threaded bores 19 and 29 in correspondingly different positions on the frame 11. By this means, greater distinction is drawn between barrels corresponding to different caliber ammunition and thus the likelihood of confusing mismatched barrels and cylinders is reduced.

As shown in FIG. 2 the locking screw 30 is just long enough to be flush with the outside portion 33 of the frame 11 when the other end 34 thereof is properly abutting the flat portion 28. If one attempts to install the locking screw 30 into the threaded bore 19 with the barrel 17*a*, as shown in FIG. 2, the extending end of the locking screw 30 would not be flush with the outside surface 35 of the frame 11 and thus would indicate that the weapon is improperly assembled. The same condition would occur if the barrel 17 were simply not properly aligned whereupon the locking screw 30 would not be in flush contact with the flat portion 28 and would extend beyond the portion 33 of the frame 11. Lastly, FIG. 2 shows the forward sight 26 in proper alignment with the rear sight 27 for the aiming of the firearm 10 as is the condition when the barrel 17 is fully threadedly engaged in the frame bore 16.

Figure 3:
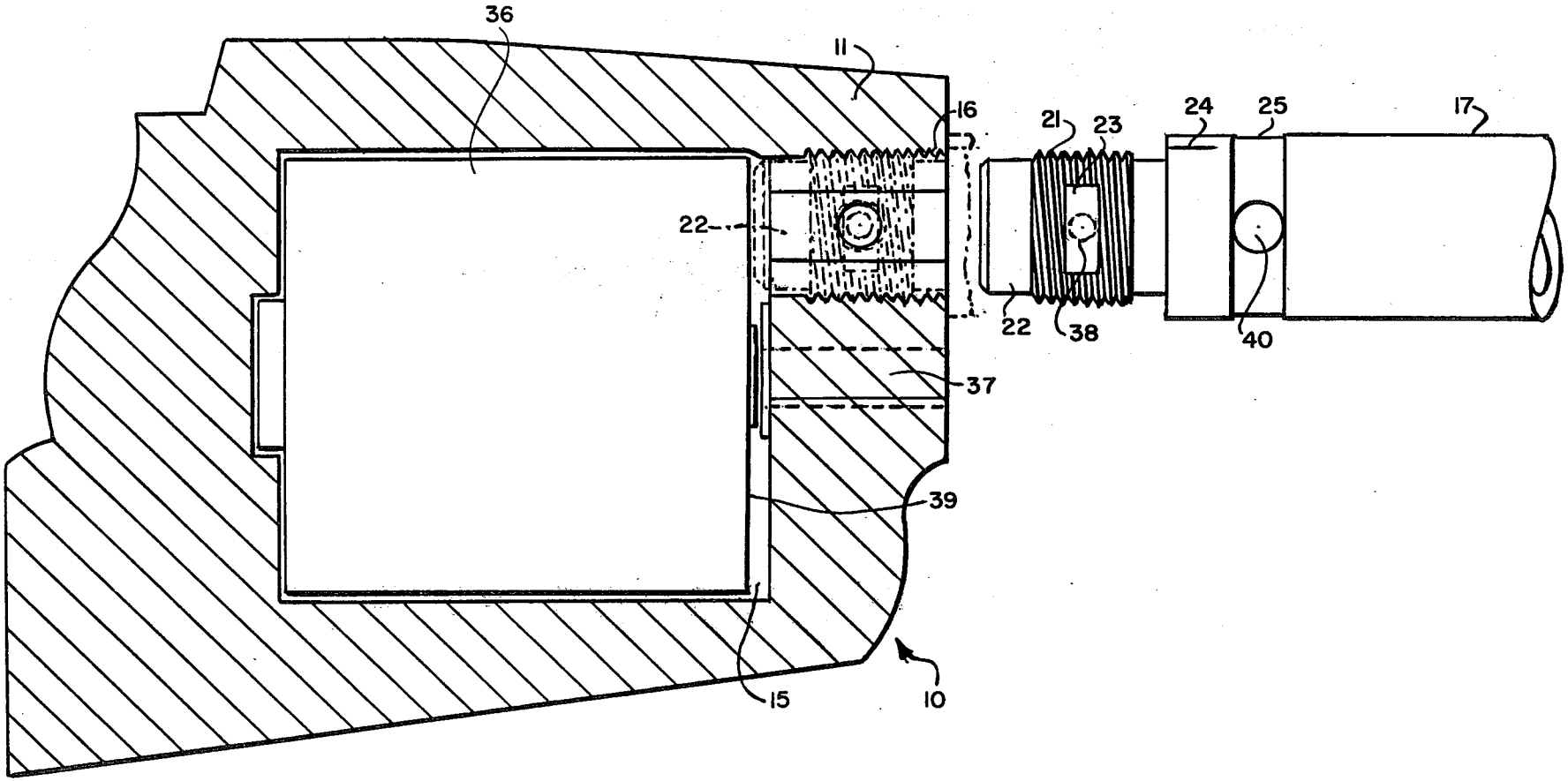
FIG. 3 is a partially sectioned side view of the frame and barrel of FIGS. 1 and 2 with an associated ammunition cylinder.

FIG. 3 shows a sectional view of the frame 11 for demonstrating the cooperation between an ammunition cylinder 36 and a longitudinal extension 22 on a barrel 17. The threaded end of the barrel 17 is shown in phantom lines installed in the frame bore 16 and in solid lines slightly removed therefrom. The ammunition cylinder 36 is shown installed in the opening 15 of the frame 11 and rotatably mounted by a removable axle means 37. The barrel 17 is shown with the flat portion 23 as per FIG. 1. On the flat portion 23 the outer diameter of a locking screw is shown in phantom lines 38. As illustrated, the width of the flat portion 23 is substantially equal to or just larger than the outer diameter of the locking screw 38 so that the locking screw 38 will only properly abut the flat portion 23 (as seen in the relation between the locking screw 30 and flat portion 28 of FIG. 2) when the barrel 17 is fully threadedly engaged in the frame bore 16. In the installed phantom rendition of the threaded end of the barrel 17 the longitudinal extension 22 is shown to reach to spaced adjacent relation with the forward end 39 of the ammunition cylinder 36. Ammunition cylinders for ammunition of larger caliber would be correspondingly larger and thus extend further towards the front of the firearm 10 causing interference by the longitudinal extension 22 therewith. The longitudinal extension for barrels of larger caliber ammunition would be shorter, thus allowing more clearance within the opening 15 for the correspondingly larger ammunition cylinders.

In a preferred embodiment the ammunition cylinders for successive calibers of ammunition vary in length by at least twice the normal clearance present between a cylinder and the longitudinal extension of its corresponding barrel when both are properly installed in the frame 11.

FIG. 3 shows a wrench engagement means 25 including a keyway 40 thus enabling the barrel 17 to be engaged by a crescent wrench (not shown) for applying torque to the barrel 17 during its installation or removal in the frame 11.

As described above the plurality of safety features of the present invention improve upon known technology by interacting to insure both that an ammunition cylinder for ammunition of larger diameter will not be used with a barrel for ammunition of smaller diameter and also that the match up in barrel and ammunition cylinder will be for ammunition of the same caliber. To this end the present invention provides a plurality of indications to the user or assembler of the firearm as to the threaded engagement of the barrel 17 in the frame bore 16 and thus to the operative condition of the longitudinal extension 22. To insure the proper threaded engagement of the barrel 17 in the bore 16 the assembler need only check the alignment of the barrel and frame alignment marks 24 and 31 or 32 and the alignment of the forward and rear sights 26 and 27. In the event that the user fails to check the alignment marks 24 and 31 or 32 and attempts to aim the firearm 10 the misalignment of the front and rear sights 26 and 27 will be a blatant reminder to the user that the barrel is not completely installed. In the event that the barrel 17 is one full revolution from proper threaded engagement, and the front and rear sights appear in good alignment, a checking of the alignment marks will possibly show a misalignment therebetween and will definitely show a space between the frame 11 and the portion of the barrel on which the alignment mark 24 appears thus indicating the lack of full threaded engagement. Also, under such a condition an attempt to properly install a locking screw in the bore 19 will be unsuccessful, as the locking screw will extend beyond the surface 35 of the frame 11 and thus indicate improper threaded engagement.

The advantages of these interacting safety features are readily apparent when a firearm constructed according to the present invention is compared with the prior art. As mentioned, the firearm disclosed in U.S. Pat. No. 3,280,495 includes a barrel which is encased in a shroud. Only the forward end of the barrel is visible and includes a nut-like portion by which the barrel can be engaged for assembly or disassembly from the frame. In the event that this barrel is not fully engaged with the threaded bore the rearward extension thereof may not be operative for interfering with ammunition cylinders for larger caliber ammunition. This condition of incomplete installation of the barrel may only be apparent from the spacing between the nut-like portion on the shroud. In the present invention such a condition would be detectable by either a misalignment between the barrel and frame marks, a spacing appearing between the barrel and frame, or misalignment between the forward and rear sights. In an embodiment including the intersecting set screws, this condition would also be indicated by a protrusion of the set screw from the side of the firearm when the set screw is tightened.

In addition to the above safety factors for preventing use of larger caliber ammunition with a barrel intended for smaller caliber ammunition, the various alternate alignment marks 31 and 32 and locking screw bores 19 and 29 provide the user or assembler with a multiplicity of indications as to which caliber ammunition cylinder and barrel he is using. Thus, these further indications will create a safety factor in preventing the combination of an ammunition cylinder for a smaller caliber ammunition with a barrel for a larger caliber ammunition which condition is undesirable and can be hazardous. The undesirability with this latter mismatch is that the accuracy of the firearm is greatly reduced and also that the spacing between the forward edge 39 of the ammunition cylinder and the rearward end of the longitudinal extension 22 will be larger and thus allow for a greater discharge of gas and debris which could be hazardous to the user of the firearm.

Figure 4:
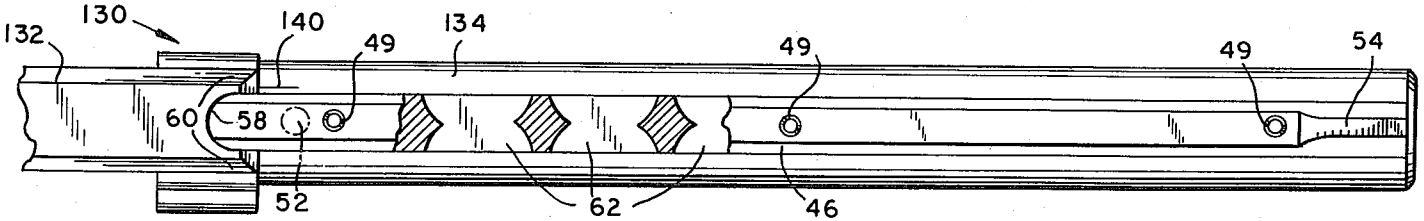
FIG. 4 is a partial top view of a firearm constructed according to another embodiment of the present invention.
Figure 5:
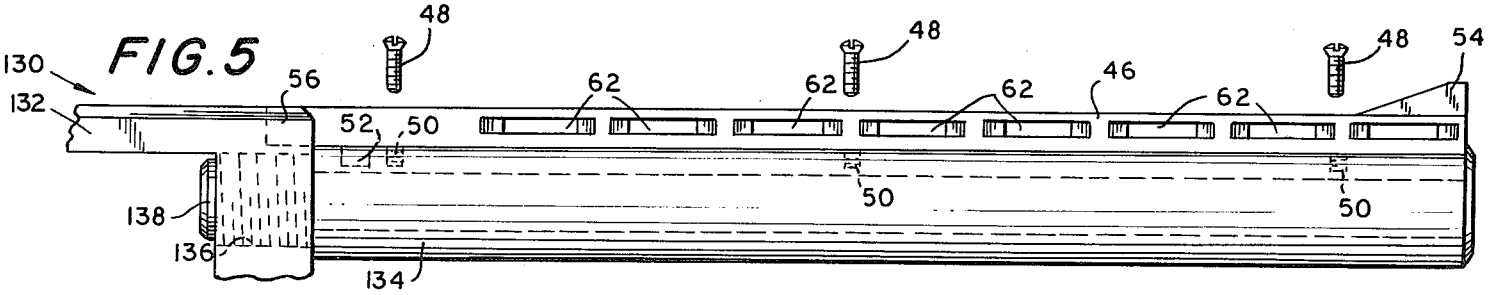
FIG. 5 is a partial side view of the firearm of FIG. 4.
Figure 6:
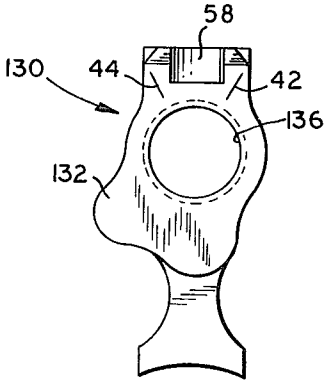
FIG. 6 is a partial front view of the firearm of FIGS. 4 and 5.

FIGS. 4, 5 and 6 illustrate a further refinement of the present invention. Each of these figures shows part of a firearm 130 having a frame 132. FIGS. 4 and 5 show a barrel 134 threadedly engaged to the frame 132 by means of the thread 136 shown in phantom lines. A portion 138 of the barrel 134 extends from the end of the barrel 134 for interfering with cylinders for ammunition having a larger caliber than that of the barrel 134 in the same manner as the extension 22 of the barrel 17 in FIGS. 1–3. The barrel 134 bears an alignment mark 140 for aligning with the mark 42 located on the frame 132. The frame 132 also has a mark 44, similar to the mark 42, which is intended for use with a different caliber barrel (not shown).

A sight rib 46 is shown attached to the barrel 134 by means of a plurality of screws 48, shown removed from the barrel 134 in FIG. 5. The screws 48 pass through holes 49 in the sight rib 46 to engage threaded holes 50 in the barrel 134 and thereby attach the sight rib 46 to the barrel 134. The sight rib 46 covers another hole 52 in the barrel 134 which hole 52 may be used to engage a suitable wrench, such as a spanner wrench, for applying torque to the barrel 134. The sight rib 46 includes a forward rib projection 54 for use with a rear sight (not shown) on the frame 132 in aiming the firearm 130. The sight rib 46 also includes an end portion 56 which extends over the thread 136 on the barrel 134. When the barrel 134 is fully threadedly engaged in the frame 132 and the sight rib 46 is properly attached, the end portion 56 of the rib 46 is received by a cavity 58 located on the front top of the frame 132. Other portions 60 of the frame 132 are located to interfere with the end 56 of the rib 46 when the barrel 134 is only partially threadedly engaged in the frame 132. This serves two purposes by preventing attachment of the rib 46 to the barrel 134 while the barrel 134 is only partially threadedly engaged in the frame 132 and also by preventing loosening of the barrel 134 from the frame 132 once it is properly installed therein and the sight rib 46 is properly attached. Also, the sight rib 46 may be ventilated by a multiplicity of openings 62. The openings 62 reduce the weight of the sight rib 46.

The sight rib 46 shown in FIGS. 4 and 5 is intended to be one of at least a plurality of sight ribs, each of which is matched to a barrel of a different caliber. The different caliber barrels may be made to different lengths rendering it unlikely that a person assembling the firearm will mismatch a barrel and sight rib. Further, the spacing between the screw holes 50 may be different from one caliber to the next for further guard against a mismatch.

When assembling a firearm 130, a barrel 134 is selected and threadedly engaged in the frame 132. First, the barrel is rotated until it is fully engaged, and then torque is applied with a wrench, such as one capable of engaging the hole 52, to align the marks 140 and 42 with each other. Next, the corresponding sight rib 46 is selected and attached to the barrel 134 by means of screws 48. If the barrel 134 is fully threadedly engaged in the frame 132, the end 56 of the sight rib 46 will align with the cavity 58 and the sight rib 46 will be easily installed. Also, the protrusion 54 will align with a rear sight to aid in aiming the firearm 130. Next, an ammunition cylinder is selected and installed in the frame 132.

The safety features of the firearm are operative during the assembling of the weapon. The sight rib 46 may only be properly attached to the barrel 134 if the portion 56 is in alignment with the cavity 58. This requirement insures that the assembler will check the degree of threaded engagement between the barrel 134 and the frame 132. Once full threaded engagement is had between the barrel 134 and the frame 132, the portion 138 of the barrel 134 will properly extend rearward to interfere with any ammunition cylinders which are attempted to be installed and which are for larger caliber ammunition than that for which the barrel is constructed.

Upon examination of the above disclosure it is readily apparent that modifications and changes may be made to the above described apparatus by one skilled in the art without departing from the nature or scope of the invention as described in the appended claims.

What is claimed is:

1. In a firearm of the type having a frame for mounting a multiple chamber ammunition cylinder, said frame having a rear sight mounted thereon, and a threaded frame bore for removably mounting a barrel, a plurality of said ammunition cylinders with each of said cylinders being adapted for use with a different caliber ammunition, means for selectively mounting any one of said plurality of cylinders for revolution on said frame, a plurality of barrels, each said barrel having a different diameter barrel bore therethrough corresponding to a different caliber of ammunition associated with one of said plurality of cylinders, each barrel having a thread engageable in said frame bore and located at one end of said barrel for allowing selective mounting of each said barrel in said frame bore, longitudinal barrel extension means located on said one end of each respective barrel and being operative when said respective barrel is fully threadedly engaged in said frame bore for interfering with the mounting and revolution of any said cylinder in said frame which cylinder corresponds to a caliber of ammunition larger than the caliber of the barrel bore of said respective barrel, an improvement which comprises a plurality of interacting safety features including a barrel alignment mark located adjacent each said barrel thread on each of said barrels, a frame alignment mark located on said frame for alignment with said barrel alignment marks when each said barrel is fully threadedly engaged in said threaded frame bore to insure full threaded engagement and thereby the operativeness of each said extension means, a plurality of sight ribs, each said rib corresponding to a different said barrel, means for attaching each said sight rib to its corresponding barrel at a predetermined location on each said barrel to enable each said sight rib to be operatively oriented with respect to said rear sight for aiding aiming of said firearm when each said barrel is fully threadedly engaged in said frame bore, and means for inhibiting attachment of each said sight rib to its corresponding barrel when each said corresponding barrel is only partially engaged in said frame bore for allowing attachment of each said sight rib to its corresponding barrel only after each said barrel is fully threadely engaged in said frame bore to require that attention be directed to the degree of engagement between a said barrel and said frame bore in order to attach each said sight rib.

2. The firearm of claim 1, wherein said means for inhibiting includes said frame having a cavity for receiving an end of each said sight rib when each said rib is attached to its corresponding barrel and said corresponding barrel is fully threadedly engaged in said frame bore, and said frame also having portions thereof located for interfering with said end of said sight rib in the attached position of each said sight rib on its corresponding barrel when said corresponding barrel is only partially threadedly engaged in said frame bore.

3. The firearm of claim 1, wherein each of said plurality of barrels and each of said plurality of sight ribs is of a different length for insuring installation of the proper corresponding sight rib on each of said barrels.

4. The firearm of claim 1, wherein each of said sight ribs is ventilated.

* * * * *